US005892461A

United States Patent [19]

Dokko

[11] Patent Number: 5,892,461

[45] Date of Patent: Apr. 6, 1999

[54] TRAFFIC CONDITION DISPLAYING SYSTEM

[76] Inventor: Joong-Hoon Dokko, RM 701, Yundang Bldg. 634-10, Sinsa-Dong, Kangnam-Ku, Seoul 135-120, Rep. of Korea

[21] Appl. No.: 937,401

[22] Filed: Sep. 24, 1997

[51] Int. Cl.[6] ..... G08G 1/095

[52] U.S. Cl. ..... 340/907; 340/905; 340/936; 340/815.41

[58] Field of Search ..... 340/907, 908, 340/936, 937, 469, 815.41, 905

[56] References Cited

U.S. PATENT DOCUMENTS

| | | | |
|---|---|---|---|
| 4,775,865 | 10/1988 | Smith et al. | 340/906 |
| 5,231,393 | 7/1993 | Strickland | 340/936 |
| 5,257,020 | 10/1993 | Morse | 340/908 |
| 5,381,155 | 1/1995 | Gerber | 340/936 |
| 5,574,428 | 11/1996 | Groover | 340/469 |

FOREIGN PATENT DOCUMENTS

| | | | |
|---|---|---|---|
| 406139491 | 5/1994 | Japan | 340/907 |

*Primary Examiner*—Daniel J. Wu
*Attorney, Agent, or Firm*—Michaelson & Wallace; Peter L. Michaelson; John C. Pokotylo

[57] ABSTRACT

A system for providing warning notices of potentially unsafe road conditions ahead. The system includes a graphic display unit, having a plurality of light emitting pixels, for displaying a road condition ahead, a display unit driver for driving the light emitting pixels of the graphic display unit, a controller for transmitting control signals and graphic data to be displayed to the display unit driver, a plurality of manually operable switches for commanding the controller to perform a programmed operation, and a car speed sensor for detecting car speed and transmitting the detected car speed to the controller.

10 Claims, 3 Drawing Sheets

TRAFFIC CONDITION DISPLAYING SYSTEM

BACKGROUND OF THE INVENTION

1. Field of the Invention

The present invention relates to a traffic condition displaying device, and more particularly to a device designed to inform a car driver that a dangerous traffic condition exists by noticing such as displaying letters, warning lamp, or warning tone, etc., before approaching a dangerous road such as a tunnel or a sharp curve.

2. Discussion of Related Art

Generally, a car runs at a high speed on the express highway and a long distance is needed to stop. Thus accidents involving vehicles colliding with obstacles happens quite often even though the driver sees such obstacles ahead and has applied a sudden break. Particularly in a dangerous place of a road where visibility is limited as with a sharp curve or tunnel, etc., many car accidents occur. If a car accident occurs within a tunnel, following cars may collide thereby causing a large car accidents.

SUMMARY OF THE INVENTION

An object of the present invention is to provide a traffic condition displaying system capable of preventing car accidents on a dangerous place such as a tunnel or a sharp curved road, by displaying a traffic condition of the dangerous road so that car drivers may acknowledge dangers before entering into the dangerous place, thereby avoiding the car accident.

To achieve the object, the present invention is to provide a traffic condition displaying system having an graphic display unit; an graphic display unit driver; a controller supplying control signals and data to drivers; and a plurality of switches generating signals so that the controller may perform the programmed operations; and a car speed sensor, thereby displaying a warning notice according to the signals of the car speed sensor or operation signals of the hand-operated switches if an emergency state has happened on the road.

A further object of the present invention is to provide a traffic condition displaying system further having a warning lamp for informing drivers of the emergency state, a lamp driver for turning on the warning lamp, a warning tone generator for informing drivers of the emergency state, and a warning tone generator driver for driving the warning tone generator, which are installed on a display panel, and also having a photo sensor making the controller control the brightness of the graphic display unit according to signals thereof, and a modem for exchanging information with a central computer.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
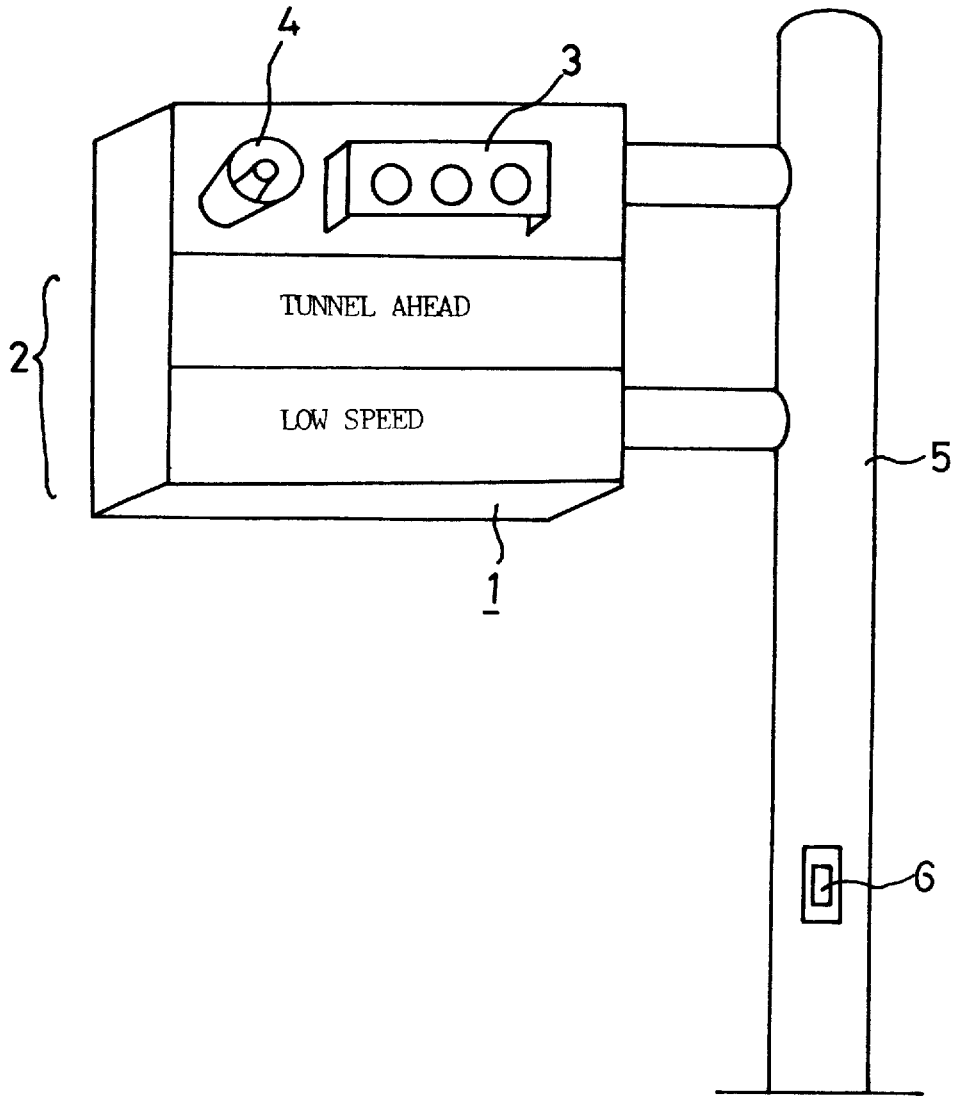
FIG. 1 is a view showing a traffic condition displaying system panel to be installed at the roadside.

FIG. 1 is a view showing a displaying system panel for displaying the road traffic condition to be installed at the roadside of the place where drivers can easily find before approaching a tunnel or a sharp curve of the road.

In FIG. 1, the displaying system panel 1 is installed at a post 5. An graphic display unit 2, a warning lamp 3 and a warning tone generator 4 are individually installed at the displaying system panel 1. Various kinds of drivers, a controller and a modem, etc., are built in the displaying system panel. An operation switch 6 is installed at a lower portion of the post 5. Text displays such as "tunnel ahead", "sharp curve", or "Lower Speed", etc. may be displayed on the upper portion of the graphic display unit 2. Some advertisement may be displayed on the lower portion of the display.

Figure 2:
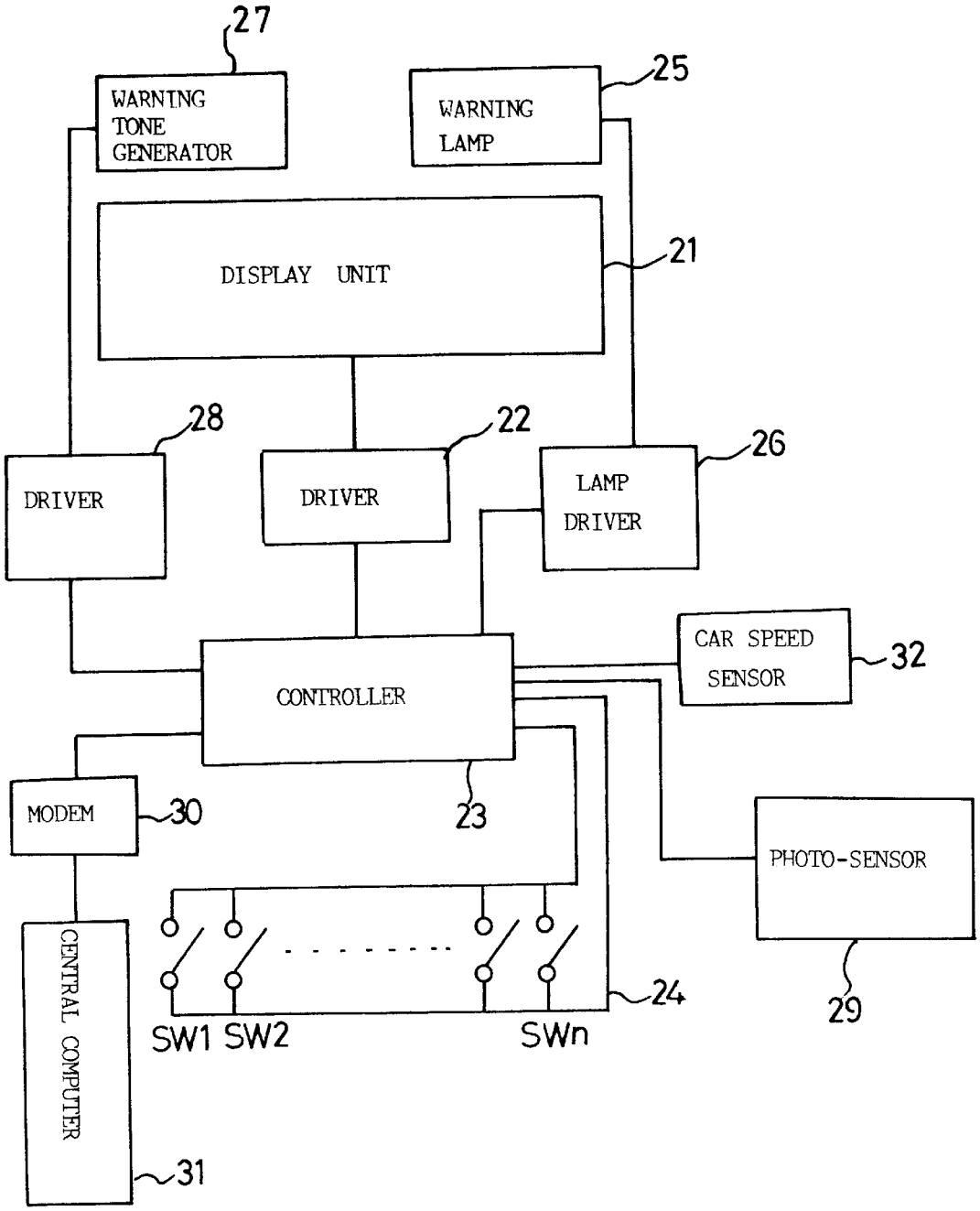
FIG. 2 is a block diagram of a road traffic condition displaying system in accordance with the present invention.

FIG. 2 is a block diagram showing a preferred embodiment of a traffic condition displaying system in accordance with the present invention.

The traffic condition displaying system has a warning lamp 25; a warning lamp driver 26; a warning tone generator 27; a warning tone generator driver 28; an graphic display unit 21; an graphic display unit driver 22; a controller 23 supplying control signals and data to the drivers; and a plurality of switches 24 generating signal so that the controller may perform the programmed operations, and a car speed sensor 32.

The system displays a warning notice according to the signals of the car speed sensor if car speed reduces under a threshold value or if operation signals of the hand-operated switches are occurred.

Most parts of the traffic condition displaying system are installed within the displaying system panel, but the car speed sensor 32 and switches are installed at a proper sides of a tunnel or a sharp curve road. The sensor and manual switches are installed in a place where a probability of a car accidents is high. For example, in case of informing the traffic condition of the tunnel, the displaying system panel is installed about five hundred meters ahead of the tunnel, and the car speed sensor 32 is installed on the both sides of the tunnel at 50 m or 100 m distance from an entrance of the tunnel. Among switches SW1, SW2, SW3, . . . , SWn, one is installed at the lower portion of the post 5, another is installed at the entrance of the tunnel, and the others are installed at the inside of the tunnel at regular intervals. Here, it is preferable that these switches are installed at intervals of fifty meters or one hundred meters. In case of the sharp curve, switches may be installed in the manner similar to the method used in the tunnel.

The graphic display unit 21 is constructed selectively among several displaying elements, however, in the present embodiment, it comprises light-emitting diode (LED) pixels in an array form. Graphics, text, or symbols may be displayed in LED pixel array by driving pixels corresponding to image to be displayed. The light-emitting diode of the graphic display unit is driven by the display unit driver 22.

Figure 3:
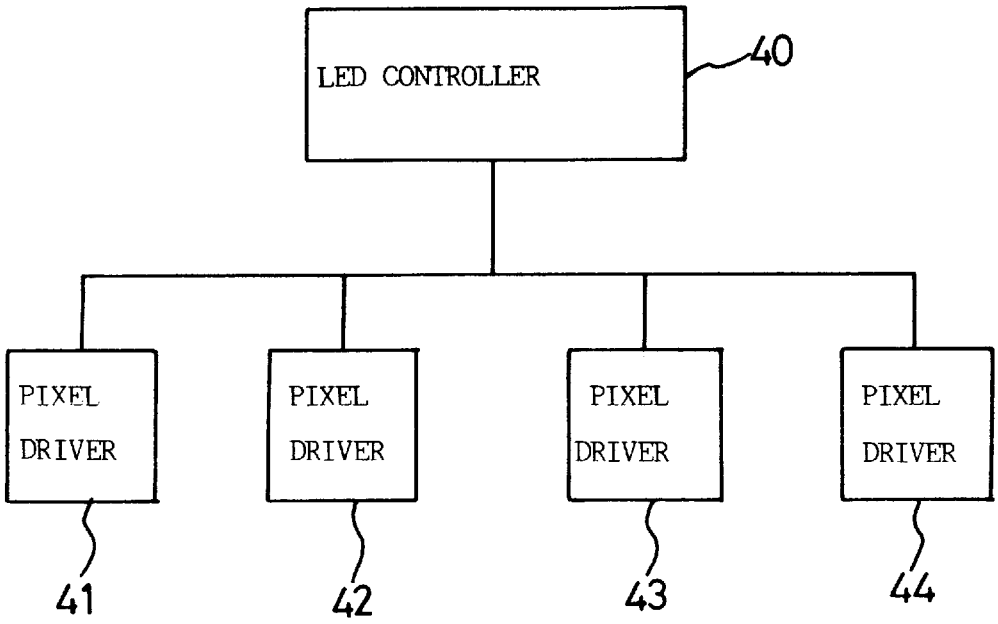
FIG. 3 is a block diagram of a Light Emitting Diode driver.

The display unit driver 22 has LED controller 40 and four pixel drivers 41–44. The LED controller 40 is connected to four pixel drivers 41, 42, 43 and 44 as shown in FIG. 3. The light-emitting state of each pixel is controlled by a corresponding pixel driver, and then each pixel driver is controlled by the LED controller. The LED controller 40 is connected to the controller 23 to be controlled according to control signals transmitted from the controller 23.

The warning lamp 25 is an incandescent bulb or a discharge lamp, and the warning lamp driver 26 turns on and off the warning lamp 25 according to signals from the controller 23 continuously. Alternatively, the lamp driver 26 may simply supply the operation power to warning lamp 25 in accordance with the control signals of the controller 23.

The warning tone generator 27 is a speaker or siren, and the warning tone generator driver 28 includes electronic circuits. The warning tone generator driver 28 receives signals from the controller 23 to generate a alternating current power to drive the speaker.

The controller 23 comprises computer system. The controller 23 generates operation control signals to the graphic display unit driver 22, the warning lamp driver 26 and the warning tone generator driver 28, respectively. The controller 23 receives signals from the photo sensor 29, switches 24 and the car speed sensor 32 to generate several operation control signals to be supplied to the aforesaid drivers according to program previously stored.

The controller 23 inputs the brightness signal from the photo sensor 29, car speed signal from the car speed sensor 32 and operation signal from switches to generate control signals used for controlling the drivers 22, 26 and 28.

If only one of switches is operated, the controller 23 performs the steps for transmitting an image predetermined by the program to the graphic display unit driver 22 so that graphic data may be displayed on the graphic display unit. Further the controller 23 transmits control signals to lamp driver 26 to operate the warning lamp 25 and to the warning tone generator driver 28 to make a warning sound from the speaker 27.

If the controller is installed to the lower portion of the post and each driver is positioned within the displaying system panel, each driver is connected to the controller by a cable. If the distance between the controller and the drivers to be connected by the cable is long, the number of lines in the cable can be reduced by installing the parallel-serial/serial-parallel converter.

With a signal from the photo sensor connected to the controller, the controller 23 can control the brightness of the light-emitting diodes according to the brightness of the road. The brightness of the light-emitting diode at day time must be much brighter than that at night The controller may be connected to the central computer through a modem to a central computer to exchange information, and send some information to the central computer in unusual state. Sometimes the controller 23 may display data supplied from the central computer.

If the accident happened on the road where the present system is installed, and any one of switches is operated or the car speed sensor detects a car traveling at a speed below the threshold value, the controller senses this and immediately transmits control signals for displaying a warning notices to the LED controller 40 for informing this road traffic condition. The LED controller receives the graphic data from the controller 23 and sends the data to each pixel drivers 41–44 for displaying. Then, notices such as "accident ahead" or "prominent danger", etc., is displayed.

Further, the controller transmits control signals to the warning lamp driver 3, thereby drives the warning lamp, and also transmits control signals to the warning tone generator driver, thereby generating the warning tone. The warning tone is generated with magnitude about 100 phone, thereby being able to warn car drivers by sound even if the car drivers do not notice a visible notice displayed in the panel 21.

If a traffic condition is normalized, the system is reset by using a reset switch (not shown). Accordingly, the traffic condition displaying system stops operations of displaying warning notices and returns to the normal operation.

In the present invention, the controller has the function of automatically controlling the brightness of the graphic display unit according to the brightness of the road, and also, informs the central computer of the road traffic condition through the modem. Accordingly, in case that the unusual state is happened, this state is provided to the central computer to be displayed on a displaying system panel installed at another place. Moreover, by using the aforesaid controller 23, several commands by the central computer 31 can displayed.

Accordingly, the present invention has an advantage capable of preventing an accident that may have otherwise happened from an express highway on a dangerous place such as the sharp curve on the general road, or, in the tunnel.

It will be apparent to those skilled in the art that various modifications and variations can be made in a traffic condition displaying system of the present invention without departing from the spirit or scope of the invention. Thus, it is intended that the present invention cover the modifications and variations of this invention provided they come within the scope of the appended claims and their equivalents.

What is claimed is:

1. A traffic condition displaying system for providing a warning notice when an emergency state happens in a car road, the system comprising:

an graphic display unit for displaying a road traffic condition, having a plurality of light emitting pixels;

a display unit driver for driving the light emitting pixels of said graphic display unit;

a controller for transmitting control signals and graphic data to be displayed to said display unit driver;

a plurality of manually operable switches for instructing said controller to perform a programmed operation;

a car speed sensor for detecting a car speed and for transmitting signals, based on the detected car speed, to said controller;

a warning lamp for providing a visible warning notice to drivers;

a lamp driver for driving said warning lamp;

a warning tone generator for providing an audible warning notice to drivers;

a warning tone generator driver for driving said warning tone generator; and a photo sensor, connected to said controller, for detecting a brightness on a road, wherein a brightness of said graphic display unit is adjusted based on a signal from the photo sensor, and wherein the visible and audible warning notices are generated together with the warning graphic data displayed according to an operation signal from at least one of the manually operable switches and the car speed from the car speed sensor.

2. A system for providing a warning notice of potentially unsafe road and traffic conditions ahead, the system comprising:

a) a graphic display unit for displaying a message concerning upcoming road and traffic conditions;

b) a plurality of switches;

c) a car speed sensor for detecting a car speed; and d) a controller for controlling the graphic display unit based on a state of the plurality of switches and a car speed detected by the car speed sensor, wherein at least some of the plurality of switches are installed at roadway beyond the graphic display unit at intervals of between 50 and 100 meters.

3. The system of claim 2 wherein the message indicates that there is an upcoming tunnel.

4. The system of claim 3 wherein the graphic display unit is arranged approximately 500 meters before the upcoming tunnel.

5. The system of claim 3 wherein the car speed sensor is arranged before an entrance of the upcoming tunnel.

6. The system of claim 3 wherein the car speed sensor is arranged at between 50 and 100 meters from an entrance of the upcoming tunnel.

7. The system of claim 4 wherein the car speed sensor is arranged before an entrance of the upcoming tunnel.

8. The system of claim 4 wherein the car speed sensor is arranged at between 50 and 100 meters from an entrance of the upcoming tunnel.

9. The system of claim 4 further comprising a reset switch for resetting the system is traffic conditions have normalized.

10. A traffic notification system comprising:

a) a central computer;

b) a first station for providing a warning notice of potentially unsafe road and traffic conditions ahead, the first station including i) a graphic display unit for displaying a message concerning upcoming road and traffic conditions, ii) a plurality of switches, iii) a car speed sensor for detecting a car speed, and iv) a controller for controlling the graphic display unit based on a state of the plurality of switches, a car speed detected by the car speed sensor, and commands from the central computer, and for providing information to the central computer; and c) a second station, located at a different place than the first station, for providing a warning notice of potentially unsafe road and traffic conditions ahead, the second station including i) a graphic display unit for displaying a message concerning upcoming road and traffic conditions, ii) a plurality of switches, iii) a car speed sensor for detecting a car speed, and iv) a controller for controlling the graphic display unit based on a state of the plurality of switches of the second station, a car speed detected by the car speed sensor of the second station, and commands from the central computer.

* * * * *